US006429844B1

(12) United States Patent
Yoon

(10) Patent No.: US 6,429,844 B1
(45) Date of Patent: Aug. 6, 2002

(54) DATA DRIVING CIRCUIT FOR LIQUID CRYSTAL PANEL

(75) Inventor: Sang Young Yoon, Inchonkwangyeok-si (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/182,641

(22) Filed: Oct. 30, 1998

(30) Foreign Application Priority Data

Nov. 1, 1997 (KR) ..... 97-57615

(51) Int. Cl.[7] ..... G09G 3/36
(52) U.S. Cl. ..... 345/98; 345/99; 345/100
(58) Field of Search ..... 345/98, 99, 100, 345/204, 214

(56) References Cited

U.S. PATENT DOCUMENTS 5,162,786 A * 11/1992 Fukuda ..... 340/784
5,523,772 A * 6/1996 Lee ..... 345/98
5,654,735 A * 8/1997 Nakajima ..... 345/99
5,726,676 A * 3/1998 Callahan, Jr. et al. ..... 345/98
5,796,379 A * 8/1998 Enomoto et al. ..... 345/98
5,856,816 A * 1/1999 Youn ..... 345/98

* cited by examiner

*Primary Examiner*—Bipin Shalwala
*Assistant Examiner*—David L. Lewis
(74) *Attorney, Agent, or Firm*—Birch, Stewart, Kolasch & Birch, LLP

(57) ABSTRACT

A data driving circuit for a liquid crystal panel with a simplified circuit configuration which enables integration of that circuit on the liquid crystal panel. The data driving circuit includes a sampling cell array for sampling video data inputted in serial from data input lines, and a serial digital to analog conversion cell array for converting the video data inputted in serial from each sampling cell in the sampling cell array into analog signals to apply the converted analog signals to each data Lines in the liquid crystal panel. Each of the sampling cells included in the sampling cell array is responsive to sequence pulses enabled exclusively and sequentially to sample a predetermined bit number of data sequentially.

9 Claims, 8 Drawing Sheets

DATA DRIVING CIRCUIT FOR LIQUID CRYSTAL PANEL

BACKGROUND OF THE INVENTION

1. Field of the Invention

This invention relates to a display apparatus employing a Liquid crystal panel, and more particularly to a data driving circuit for a liquid crystal panel that drives the liquid crystal panel with a digital image signal.

2. Description of the Prior Art

Recently, in image media, there has been a trend toward the use of digital, as opposed to analog, image signals. Digital image signals San be more easily compressed, providing a high resolution picture to a viewer. As a result, it becomes desirable for liquid crystal displays to be driven by analog as well as digital image signals. According to the driving circuit for the liquid crystal display panel has been configured to be adaptable for driving picture elements(or pixels) in a liquid crystal panel requiring an analog signal. As a result, in the liquid crystal display apparatus, analog-type data driving circuits now coexist with digital-type data driving circuits.

Since each digital-type data driving circuits process pixel data in parallel, they require high capacity of memories and use digital to analog D-A converters having a complex circuit configuration. As shown in FIG. 1, in order to drive data lines DL1 to DL2400, the digital-type data driving circuit 20 includes first latches 22 connected to data buses DB1 to DB3, and second latches 24, and a digital to analog(D-A) converter array 26 cascade-connected to the first latches 22. The first and second latch arrays 22 and 24 include 2400 latches, respectively. Each of the latches has a length of 6 bits to receive 6 bit pixel data.

That is, as shown in FIG. 2, the latches included in the first and second latches 22 and 24 each include six 1-bit latches which each consist of two inverters INV1 and INV2, an MOS transistor MN1 and a capacitor C1. The 2400 latches in the first latch array 22 are sequentially driven in accordance with a logical value of an output signal of a shift register 28 to sample 6 bits of red(R), green(G) or blue(3) color pixel data from the data bus DB. The first latch array 22 temporarily stores R, G and S pixel data for one line, that is, 2400 pixel data. The 2400 latches included in the second latch array 24 respectively receive pixel data from the 2400 latches in the first latch array 22 simultaneously, and transfer the received pixel data to the D-A converter array 26. The D-A converter array 26 converts the 2400 pixel data received from the second Latch array 24 into pixel signals, and applies the converted 2400 pixel signals to the 2400 data lines DL1 to DL 2400 in the liquid crystal panel 10, respectively. To this end, the D-A converter array 26 includes 2400 D-A converters. Each of these 2400 D-A converters receives 6 bit pixel data simultaneously and generates a pixel signal having voltage level that differs in accordance with a logical value of the 6 bit pixel data.

Meanwhile, in liquid crystal display devices, there has been a trend toward integrating the data driving circuit on the liquid crystal panel in order to reduce its bulk size. When integrating the data driving circuit on the liquid crystal panel, the size of liquid crystal panel becomes enlarged memories and complex D-A converters are typically large components. More specifically, since it is difficult to achieve a fine pitch by forming poly-silicon thin film transistors at a low temperature, the data driving circuit occupies an increasing wide area of the liquid crystal panel.

SUMMARY OF THE INVENTION

It is an object of the present invention to provide a data driving circuit for a liquid crystal pane having a simplified circuit configuration and being capable of integration on the liquid crystal panel.

In order to attain this and other objects of the invention, a data driving circuit for a liquid crystal panel includes data input lines for inputting video data in serial, a sampling cell array for sampling the video data inputted in serial from the data input lines, a serial digital to analog conversion cell array for converting the video data inputted in serial from each sampling cell in the sampling cell array into analog signals to apply the converted analog signals to each data lines in the liquid crystal panel, and sampling control means for supplying sequence pulses enabled exclusively and sequentially to each sampling cell included in the sampling cell array, thereby allowing the respective sampling cell to sample a predetermined bit number of data sequentially.

Further scope of applicability of the present invention will become apparent from the detailed description given hereinafter. However, it should be understood that the detailed description and specific examples, while indicating preferred embodiments of the invention, are given by way of example only, since various changes and modifications within the spirit and scope of the invention will become apparent to those skilled in the art from this detailed description.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
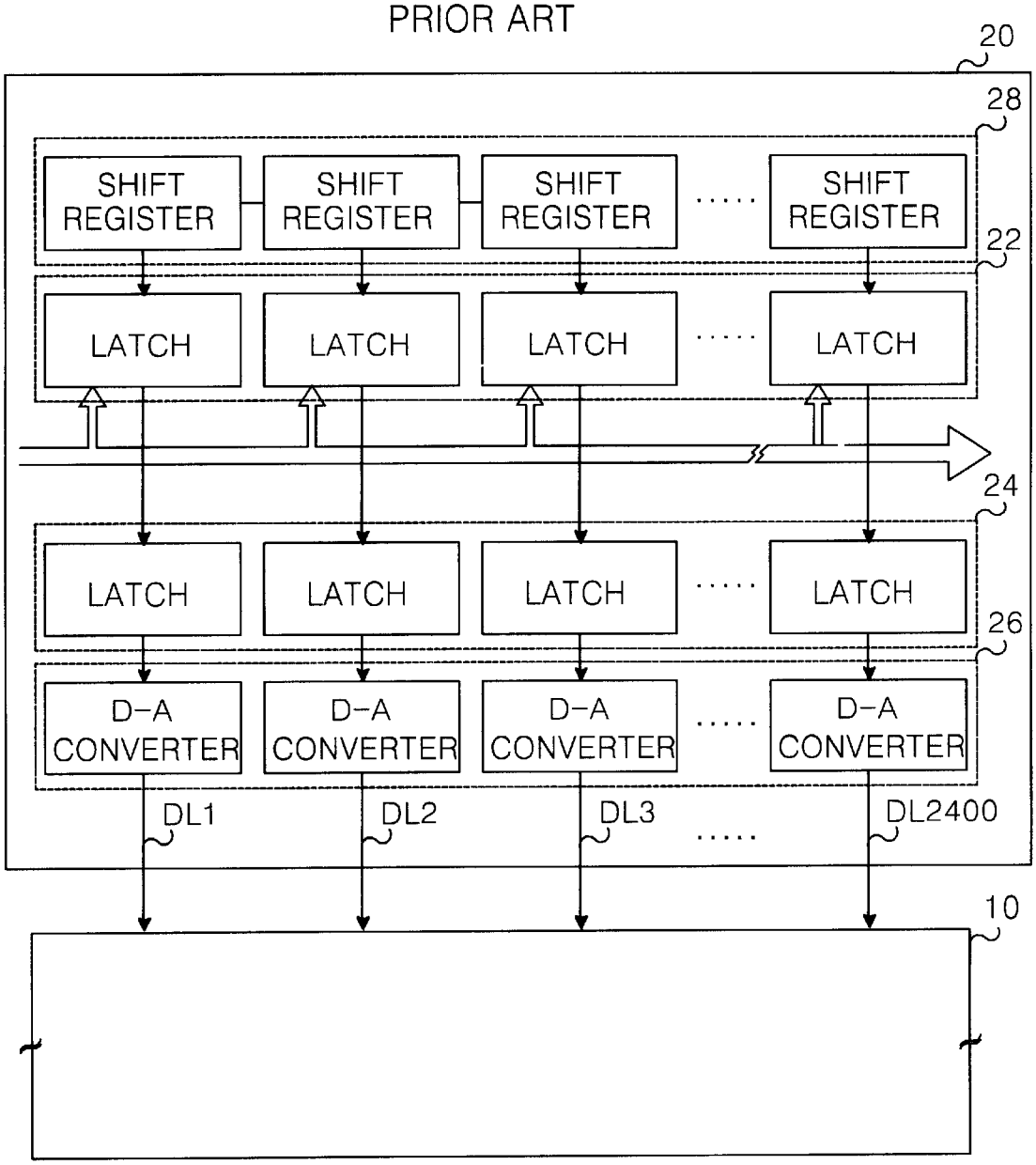
Fig.1 PRIOR ART
FIG. 1 shows a configuration of a liquid crystal display apparatus employing the conventional data driving circuit for a liquid crystal panel.
Figure 2:
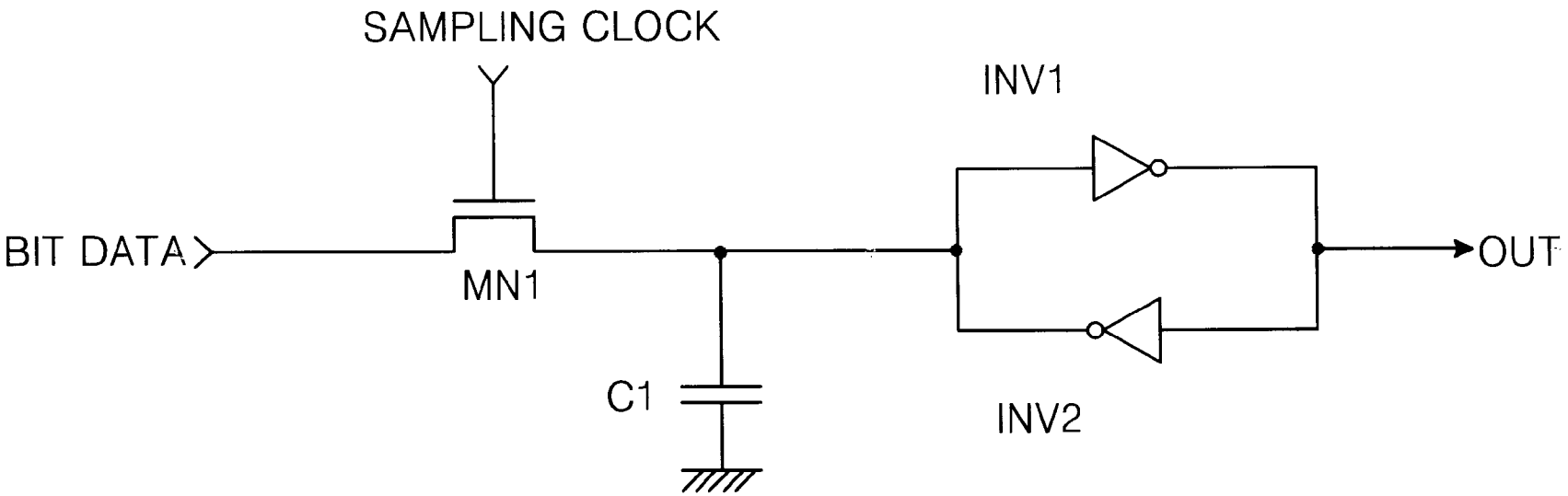
Fig.2 PRIOR ART
FIG. 2 illustrates a detailed circuit diagram of an 1 bit latch included in each latch in FIG. 1.
Figure 3:
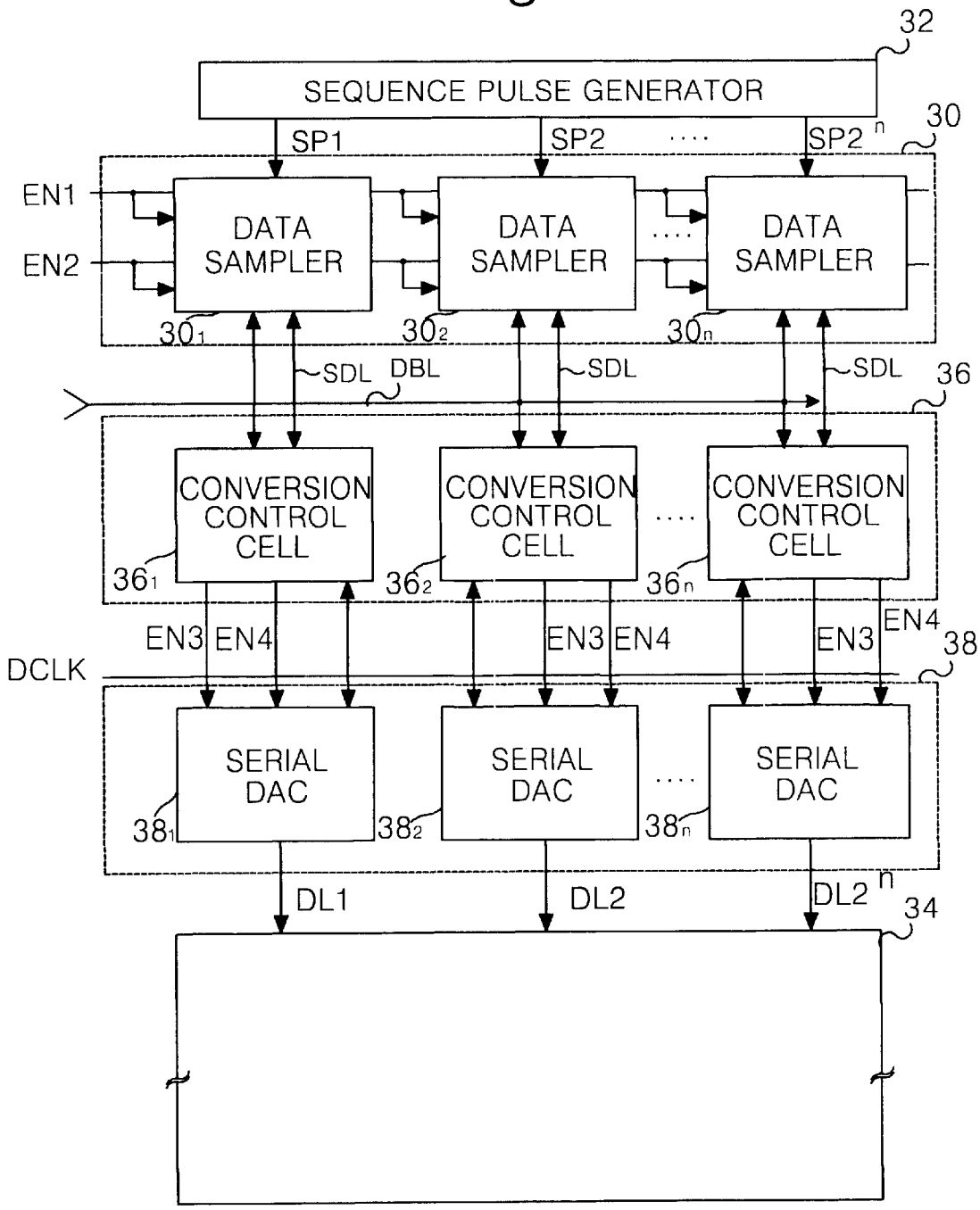
FIG. 3 illustrates a block diagram of a data driving circuit for a liquid crystal panel according to an embodiment of the present invention.
Figure 4:
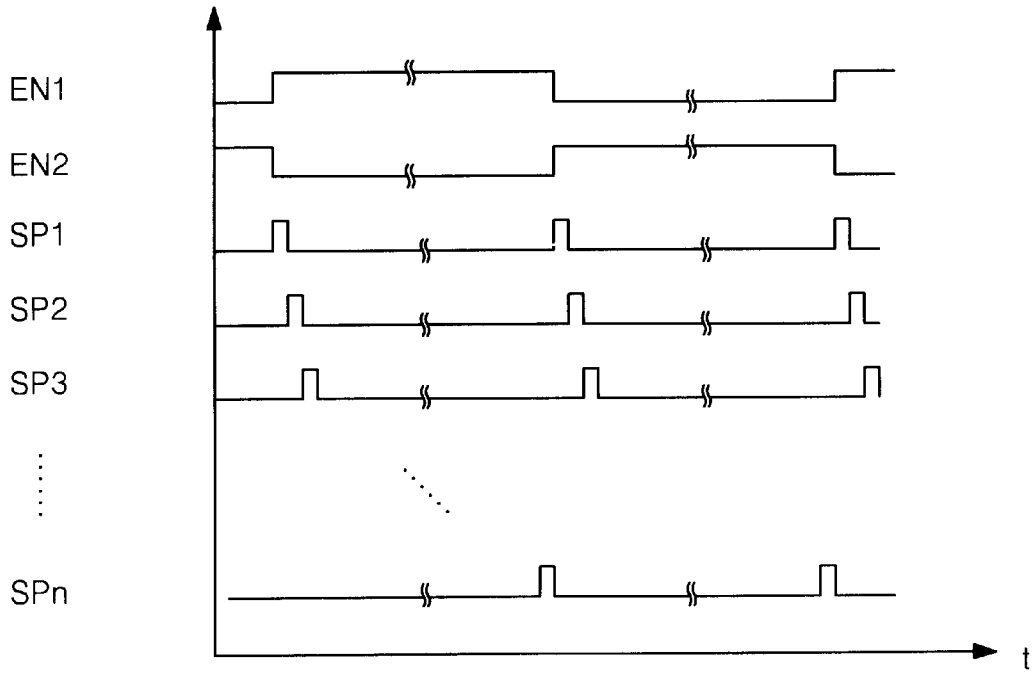
FIG. 4 illustrates waveform diagrams of sampling clock signals generated at the sequence pulse generator shown in FIG. 3.

FIG. 3 shows an example of a data driving circuit for a liquid crystal panel according to an embodiment of the present invention. The data driving circuit of FIG. 3 includes a data sampler array 30 connected to a data bit line DBL and a sequence pulse generator 32. Sequence pulse generator 32 applies sequence pulses SP1 to SP2$^n$ to the data sampler array 30. The data sampler array 30 consists of 2(e.g., 2400) data samplers $\mathbf{30}_1$–$\mathbf{30}_n$ for commonly receiving first and second enable signals EN1 and EN2 as shown FIG. 4. These data samplers $\mathbf{30}_1$–$\mathbf{30}_n$ each includes first and second sampling cell respectively responding to the first and second enable signals EN1 and EN2 as shown in FIG. 4. These first sampling cells are sequentially driven with sequence pulses SP1 to SP2$^n$ from the sequence pulse generator 32 when the first enable signal EN1 has a high logic. Also, the first sampling cells sequentially sample 1 bit data in serial data transferred to the data bit line DBL. Similarly, these second sampling cells are sequentially driven with sequence pulses SP1 to SP2$^n$ from the sequence pulse generator 32 when the second enable signal EN2 has a high logic. Also, the second sampling cells sequentially samples 1 bit data in serial data transferred to the data bit line DBL. Consequently, the first and second sampling read cells alternatively driven by the first and second enable signals.

The sequence pulse generator 32, which generates the 2$^n$ sequence pulses SP1 to SP2$^n$, can include 2$^n$ stages of shift register that are responsive to a start pulse not shown. Alternatively, the sequence pulse generator 32 may be implemented using a logic decoder that is responsive to n pulse signals (not shown) and has 2$^n$ output lines. As shown in FIG. 4, the 2$^n$ sequence pulses SP1 to SP2$^n$, which are generated at the sequence pulse generator 32 are applied to the 2$^n$ data samplers, respectively, to sequentially enable those data samplers.

The liquid crystal data driving circuit further includes a conversion control cell array 36 and a serial D-A converter array 38. The conversion control cell array 36 and serial D-A converter array 38 are connected in casecade between the data sampler array 30 and the liquid crystal panel 34. Conversion control cell array 36 includes 2$^n$ conversion control cells $\mathbf{36}_1$–$\mathbf{36}_n$ which are correspondingly connected to the 2$^n$ data samplers $\mathbf{30}_1$–$\mathbf{30}_n$ and which commonly receive a conversion driving clock DCLK. Each of the 2$^n$ conversion control cells $\mathbf{36}_1$–$\mathbf{36}_n$ are responsive to 1-bit data sequentially applied from each data sampler $\mathbf{30}_1$–$\mathbf{30}_n$ over six times and to an external conversion driving clock DCLK. Each conversion control cell $\mathbf{36}_1$–$\mathbf{36}_n$ generates third and fourth enable signals EN3 and EN4. The third and fourth enable signals EN3 and EN4 generated at each of the conversion control cell $\mathbf{36}_1$–$\mathbf{36}_n$ change as indicated in the following Table 1 in accordance with logical values of the 1-bit data (SDL) and the conversion driving clock DCLK:

TABLE 1

| DCLK | DATA | EN3 | EN4 |
|---|---|---|---|
| 0 | 0 | 1 | 1 |
| 0 | 1 | 0 | 0 |
| 1 | 0 | 1 | 0 |
| 1 | 1 | 1 | 0 |

Figure 5:
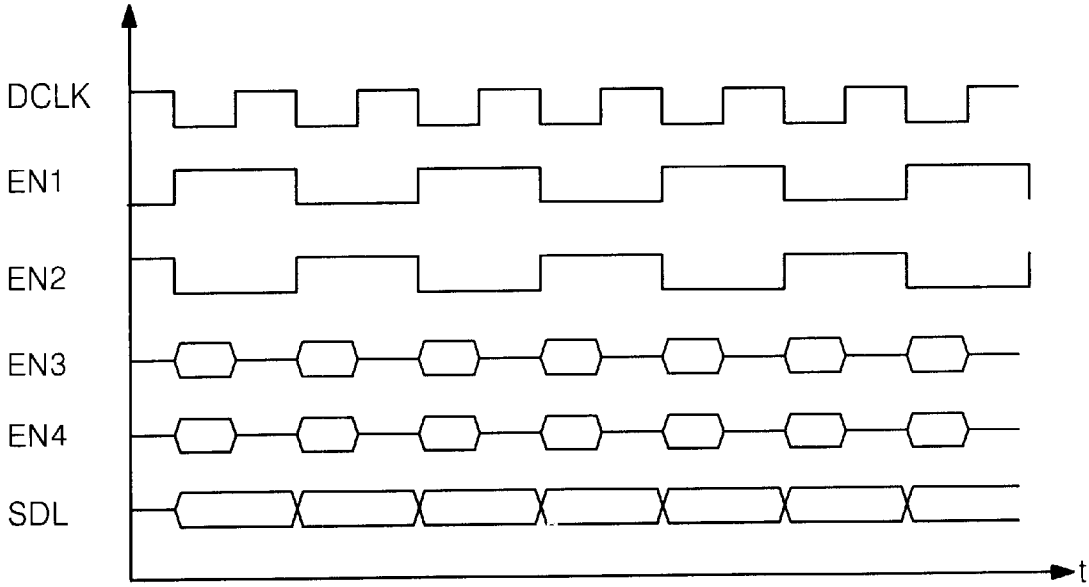
FIG. 5 illustrates waveform diagrams of output and input signals of the conversion control cell shown in FIG. 3.

Further, input and output signals of the conversion control cell $\mathbf{36}_1$–$\mathbf{36}_n$ have waveforms shown in FIG. 5 with respect to a scan pulse SP.

The serial D-A converter array 38 includes 2$^n$ serial D-A converters $\mathbf{38}_1$–$\mathbf{38}_n$ which are correspondingly connected to the 2$^n$ conversion control cells $\mathbf{36}_1$–$\mathbf{36}_n$ respectively, and which commonly receive the conversion driving clock DCLK. Each of these serial D-A converters $\mathbf{38}_1$–$\mathbf{38}_n$ successively performs a converting operation over six times based on the conversion driving clock DCLK and the third and fourth enable signals EN3 and EN4 from one of the conversion control cells $\mathbf{36}_1$–$\mathbf{36}_n$ thereby generating an analog signal having a voltage level corresponding to a logical value of 6-bit serial data sampled by the corresponding data sampler $\mathbf{30}_1$–$\mathbf{30}_n$ The 2$^n$ analog signals generated at the serial D-A converters $\mathbf{38}_1$–$\mathbf{38}_n$ are applied to the 2$^n$ data lines DL1 to DL2$^n$ in the liquid crystal panel 34.

Figure 6:
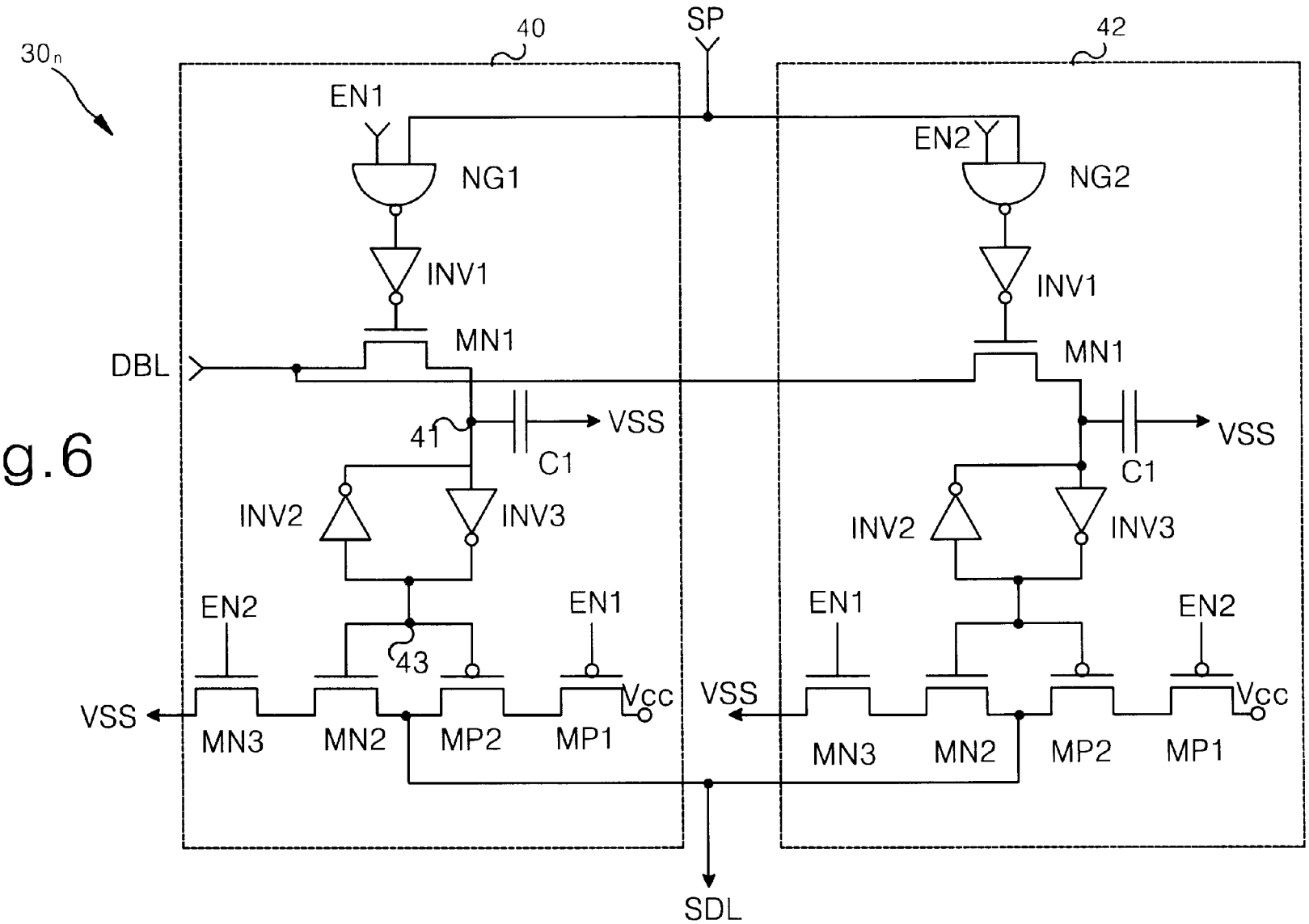
FIG. 6 illustrates a detailed circuit diagram of the data sampler shown in FIG. 7.

FIG. 6 is a detailed circuit diagram of each data sampler included in the data sampler array 30 (FIG. 3). As shown in FIG. 6, each data sampler includes first and second sampling cells 40 and 42 that are commonly responsive to a sequence pulse SP from sequence pulse generator 32.

The first sampling cell 40 samples data from the data bit line DBL when both the first enable signal EN1 and the sequence pulse SP have a high logic. To this end, the first sampling cell 40 includes an NAND gate NG1, a first NMOS transistor MN1, and a capacitor C1. NAND gate NC1 performs a NAND operation using the sequence pulse SP and the first enable signal EN1 as inputs. The first NMOS transistor MN1 is connected between the data bit line DBL and a first node 41. The first NMOS transistor MN1 is controlled based on an input from NAND gate NG1 to its gate through inverter INV1. It is turned on during a time interval when a signal applied from the NAND gate NG1 remains at a high logic, enabling 1-bit of data to pass from the data bit line DLB into the capacitor C1 connected to the first node 41. Capacitor C1 is charged or discharged in accordance with a logical value of data on the data bit line DLB. More specifically, the capacitor C1 is charged with voltage when the 1-bit data has a logical value of "1" to supply high logic data on the first node 41; while it is discharged with voltage when the 1-bit data has a logical value of "0" to emerge low logic data on the first node 41.

The first sampling cell 40 further includes second and third inverters INV2 and INV3 that are connected to form a circuit loop between the first node 41 and a second node 43, first and second PMOS transistors MP1 and MP2 that are connected in serial between the sample data line SDL arid a supply voltage source VCC, and second and third NMOS transistors MN2 and MN3 that are connected in serial between the sample data line SDL and a ground voltage source VSS. The circular loop formed by inverters INV2 and INV3 performs two simultaneous functions. First, it maintains the 1-bit data on the first node 41; second, it simultaneously performs the function of a unit memory cell which transfers the data on the first node 41 to the second node 43 in an inverted state. The first PMOS transistor MP1 selectively connects the supply voltage source VCC to the second PMOS transistor MP2 in accordance with a logical state of the first enable signal EN1. The second PMOS transistor MP2 selectively connects the supply voltage source VCC, if received from the first PMOS transistor MP1, to the sample data line DSL in accordance with a logical value of the data on the second node 43. On the other hand, the third NMOS transistor MN3 selectively connects the second NMOS transistor MN2 to the ground VSS in accordance with a logical state of the second enable signal EN2. The second NMOS transistor MN2 operates as a complement to the second PMOS transistor MP2 in accordance with the data on the second node 43. That is, the second NMOS transistor MN2 selectively connects ground voltage VSS, if connected via the third NMOS transistor MN3, to the sample data line SDL in accordance with a logical value of the data on the second node 43.

Like the first sampling cell 40, the second sampling cell 42 samples data from the data bit line DBL. However, unlike the first sampling cell 40, the second sampling cell 42 samples data from the data bit line DBL when both the second enable signal EN2 and the sequence pulse SP have a high logic, and supplies the sampled data to the sample data line SDL. Second sampling cell 42 includes circuit components which perform similar functions and operations as those in the first: sampling cell 40.

Therefore, a detailed description as to them will be omitted.

Figure 7:
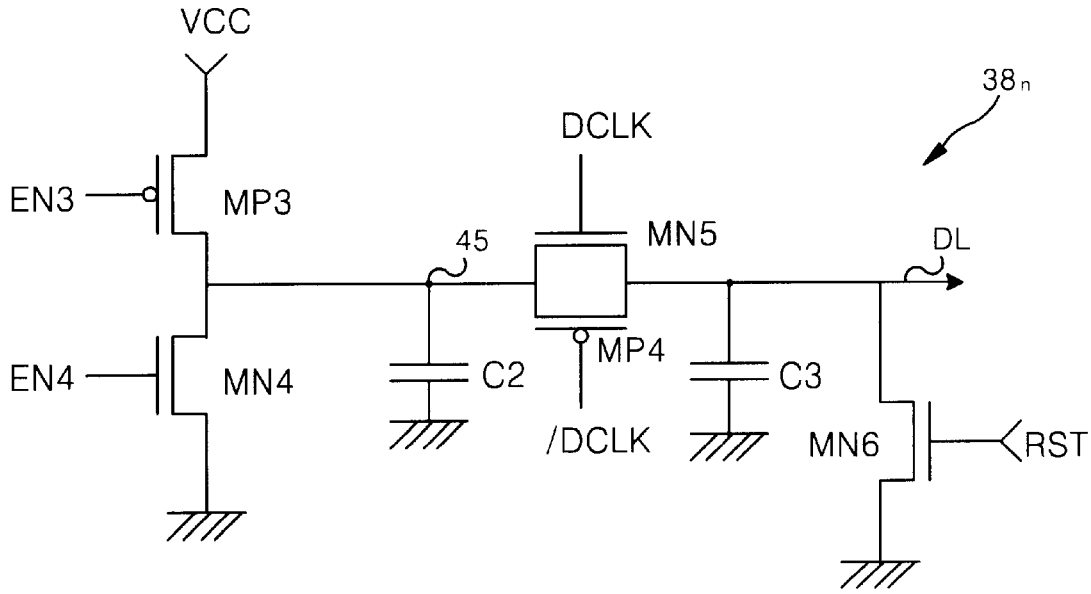
FIG. 7 illustrates a detailed circuit diagram of a first embodiment of the serial D-A converter shown in FIG. 3.

FIG. 7 is a detailed circuit diagram of the first embodiment of the serial D-A converter 38, shown in FIG. 3. As shown in FIG. 7, the serial D-A converter 38, includes a third PMOS transistor MP3, a fourth NMOS transistor MN4 and a second capacitor C2 that are commonly connected to a third node 45. The third PMOS transistor MP3 is responsive to the third enable signal EN3 to selectively pass a supply voltage from the supply voltage source VCC to the second capacitor C2, thereby charging the second capacitor C2 to attain an analog signal corresponding to a "1" bit data at the third node 45. On the other hand, the fourth NMOS transistor MN4 is responsive to the fourth enable signal EN4 to selectively discharge the voltage stored in the second capacitor C2 to the ground VSS, whereby an analog signal corresponding to a "0" bit data is approached at the third node 45.

The serial D-A converter 38, further includes a fourth PMOS transistor MP4 and a fifth NMOS transistor MN5 that are connected in parallel between the third node 45 and the data line DL in the liquid crystal panel 34, and a third capacitor C3 and a sixth NMOS transistor MN6 that are connected in parallel between the data line DL and ground VSS. In response to an inverted conversion driving clock /DCLK, the fourth PMOS transistor MP4 is turned on repetitively to charge the analog signal on the third node 45 into the third capacitor C3. As a result, an analog signal corresponding to a logical value of 6-bit serial data appears on the data line DL. The fifth NMOS transistor MN5 is turned on the same time as the fourth PMOS transistor MP4 in response to an conversion driving clock DCLK, thereby allowing the analog signal on the third node 45 to be transferred to the data line DL at a rapid rate. In other words, the parallel connection of the fifth NMOS transistor MN5 with the fourth PMOS transistor MP4 enlarges an amount of current flowing from the third node 45 into the data line DL. Finally, the sixth NMOS transistor MN6 is opened and closed responsive to a reset signal RST to discharge a charged voltage in the third capacitor C3 into the ground VSS, thereby initializing the analog signal on the data line DL into "0V".

Figure 8:
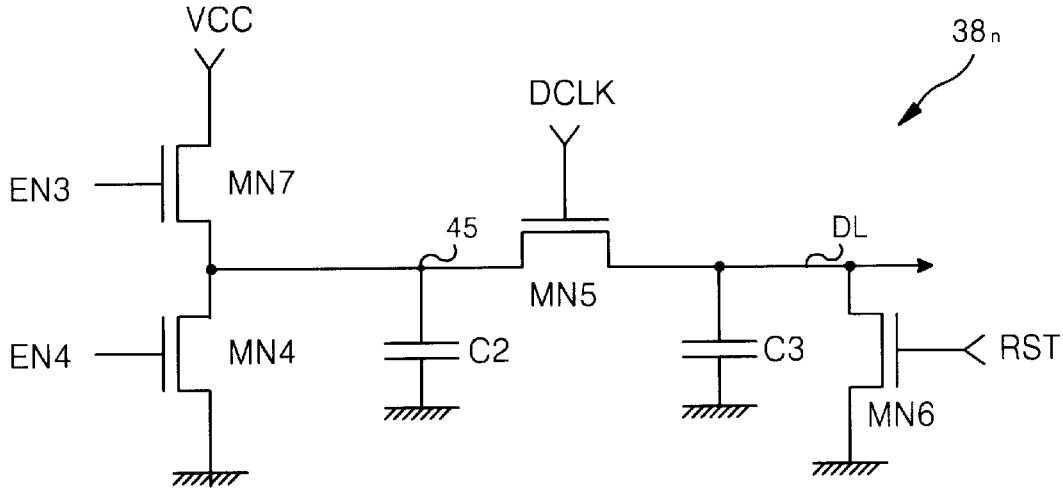
FIG. 8 illustrates a detailed circuit diagram of a second embodiment of the serial D-A converter shown in FIG. 3.

FIG. 8 is a detailed circuit diagram of the second embodiment of the serial D-A converter shown in FIG. 3. The serial D-A converter shown in FIG. 8 has a configuration an which the third PMOS transistor MP3 of the serial converter in FIG. 7 is replaced by a seventh NMOS transistor MN7, and the fourth PMOS transistor MP4 therein is eliminated. This serial D-A converter 38, includes NMOS transistors only. Thus, it can be formed on the surface of the liquid crystal panel 34. Furthermore, its fabrication process can be simplified compared with the serial D-A converter in FIG. 7. The serial D-A converter shown in FIG. 8 is useful in combination with conversion control cells that operate to achieve the logic states operate shown in the following Table 2;

TABLE 2

| DCLK | DATA | EN3 | EN4 |
|---|---|---|---|
| 0 | 0 | 0 | 1 |
| 0 | 1 | 1 | 0 |
| 1 | 0 | 0 | 0 |
| 1 | 1 | 0 | 0 |

Figure 9:
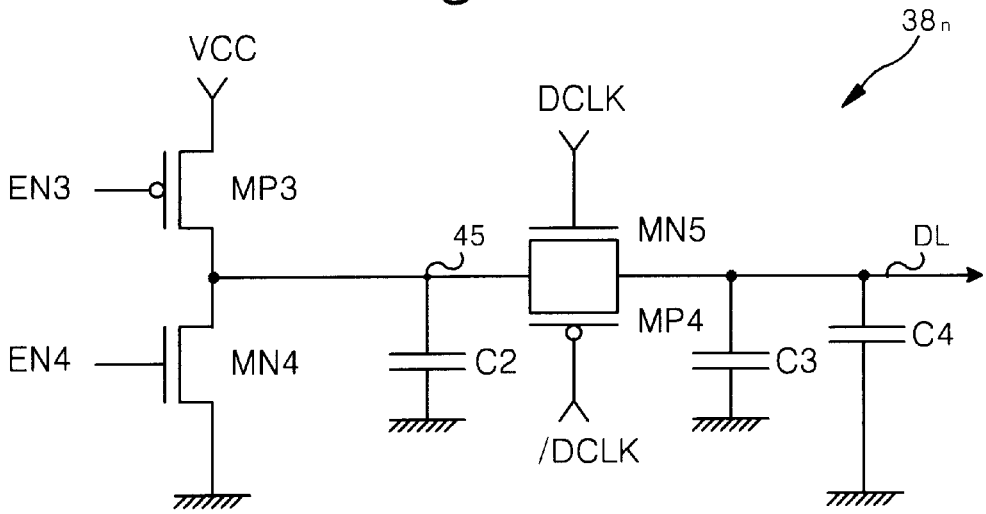
FIG. 9 illustrates a detailed circuit diagram of a third embodiment of the serial D-A converter shown in FIG. 3.

FIG. 9 is a detailed circuit diagram of the third embodiment of the serial D-A converter shown in FIG. 3. The serial D-A converter shown in FIG. 9 has a configuration in which the sixth NMOS transistor MN6 shown in the serial converter in FIG. 7 is replaced by a fourth capacitor C4. The fourth capacitor C4 compensates a voltage deviation in an analog signal applied to the data line DL due to a capacitance deviation in the third capacitor C3. A capacitance value of the fourth capacitor C4 may be determined by the following formula (1).

$$C4=C2-C3 \quad (1)$$

Figure 10:
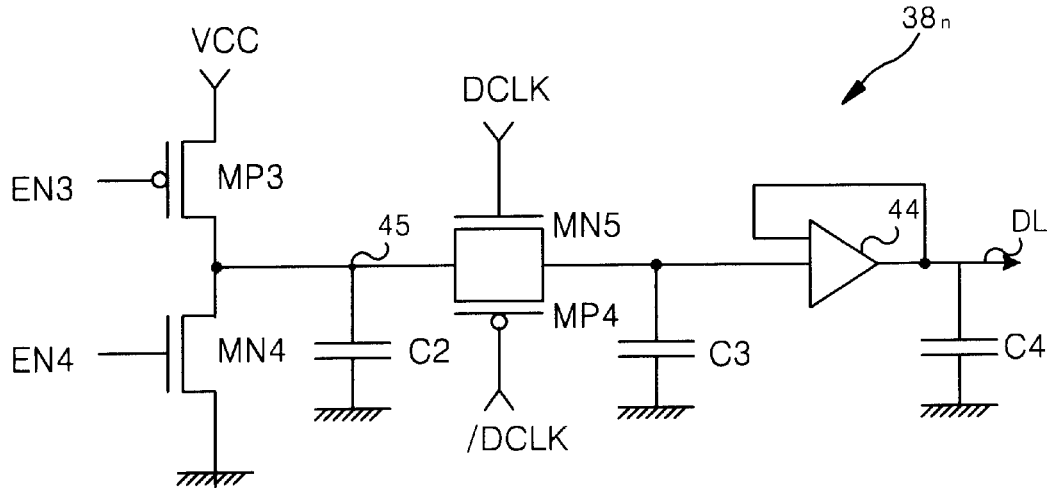
FIG. 10 illustrates a detailed circuit diagram of a fourth embodiment of the serial D-A converter shown in FIG. 3.

FIG. 10 is a detailed circuit diagram of the fourth embodiment of the serial D-A converter shown in FIG. 3. The serial D-A converter shown in FIG. 10 has a configuration in which a voltage follower 44 is added between the third and fourth capacitors C3 and C4 in the serial D-A converter shown in FIG. 9. The voltage follower 44 buffers an output signal of the third capacitor C3 and delivers the buffered voltage toward the fourth capacitor C4 connected to the data line DL, thereby compensating a voltage deviation in the data line DL due to a capacitance deviation in the fourth capacitor C4.

Figure 11:
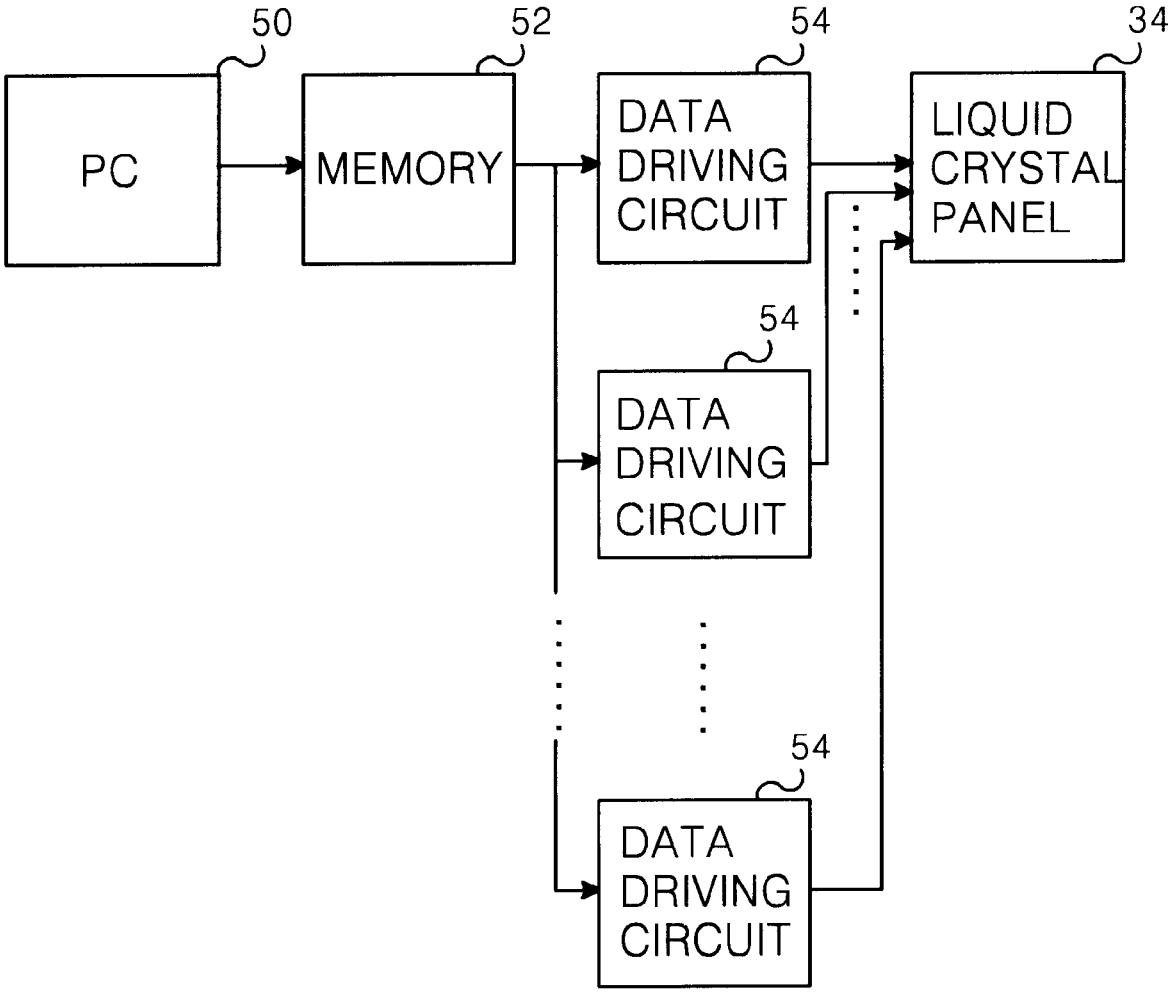
FIG. 11 illustrates a schematic block diagram showing a configuration of a liquid crystal display apparatus employing a data driving circuit according to an embodiment of the present invention.

FIG. 11 shows a block diagram of a liquid crystal display apparatus employing a data driving circuit for a liquid crystal panel, according to an embodiment of the present invention. Referring now to FIG. 11, a personal computer 50 outputs 18-bits red, green and blue data successively. A memory 52 successively stores single lines of the data supplied from the personal computer 50 in 18-bit units. The data units stored by the memory 52 are supplied to consecutive data driving circuits 54 as a stream of bits. Accordingly, each data driving circuit 54 divides and drives the data lines of the liquid crystal panel 34 based on the $2^n$ units.

As described above, in a data driving circuit for a liquid crystal panel according to the present invention, video data is converted into analog signals using serial D-A converters. Thus, it becomes possible to shorten the number of memory cells for storing the video data and the number of wiring lines, as well as to simplify a configuration of the D-A converters. Accordingly, the liquid crystal panel data driving circuit can be integrated in the narrow area of the liquid crystal panel, and also can be easily fabricated on the liquid crystal panel by the fabrication process of the low temperature ploy thin film transistors.

Although the present invention has been explained by the embodiments shown in the drawings described above, it should be understood by the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A data driving circuit for driving a liquid crystal panel, comprising:

a data input line for inputting a bit stream having bits of video data;

a sampler array including a plurality of samplers arranged in parallel, each sampler sampling a different portion of the bit stream of video data from the data input line, each sampler including, a first sampling cell, responsive to a first enable signal, for sampling one-bit of video data to output the sampled video bit of data, a second sampling cell, responsive to a second enable signal, an inverse of the first enable signal, for sampling one bit of video data in complement to the first sampling cell to output the sampled bit of video data, and the first sampling cells sampling in sequence when the first enable signal is enabled, and the second sampling cells sampling in sequence when the second enable signal is enabled; and a digital-to-analog conversion cell array including plural digital-to-analog conversion cells arranged in parallel, each digital-to-analog conversion cell generating an analog signal based on the sampled video data bit sequentially output by a corresponding one of the first and second sampling cells, and applying the analog signal to a corresponding data line of the liquid crystal panel;

wherein each digital-to-analog conversion cell includes:

a first capacitor connected between a node and a ground source;

a second capacitor connected between the data line and the node;

a first transistor, responsive to a third enable signal, for selectively passing a supply voltage from a supply voltage source to the first capacitor;

a second transistor, responsive to a fourth enable signal, for selectively discharging a voltage stored in the first capacitor to the ground source;

a third transistor, responsive to a conversion driving clock, connected between the node and the data line; and a fourth transistor, responsive to a reset signal, for discharging a charged voltage in the second capacitor into the ground source.

2. The circuit of claim 4, wherein each first and second sampling cell includes:

a bit memory for storing the bit data;

a first switching element, responsive to one of the first and second enable signals, applying the one bit of video data from the data input line to the bit memory; and a second switching element, responsive to another one of the first and second enable signals, to transfer the bit of video data from the bit memory to the corresponding digital-to-analog conversion cell.

3. The circuit of claim 2, wherein the second switching element performs a buffering of the bit of video data from the bit memory to the digital-to-analog conversion cell.

4. The circuit of claim 1, further comprising:

a conversion control cell, corresponding to each digital-to analog conversion cell, generating the third and fourth enable signals based on output from an associated one of the first and second sampling cells.

5. The circuit of claim 1, wherein each digital-to-analog conversion cell includes a fifth transistor connected in parallel with the third transistor and responsive to a conversion driving clock.

6. A data driving circuit for driving a liquid crystal panel, comprising:

a data input line for inputting a bit stream having bits of video data;

a sampler array including a plurality of samplers arranged in parallel, each sampler sampling a different portion of the bit stream of video data from the data input line, each sampler including, a first sampling cell, responsive to a first enable signal, for sampling one-bit of video data to output the sampled video bit of data, a second sampling cell, responsive to a second enable signal, an inverse of the first enable signal, for sampling one bit of video data in complement to the first sampling cell to output the sampled bit of video data, and the first sampling cells sampling in sequence when the first enable signal is enabled, and the second sampling cells sampling in sequence when the second enable signal is enabled; and a digital-to-analog conversion cell array including plural digital-to-analog conversion cells arranged in parallel, each digital-to-analog conversion cell generating an analog signal based on the sampled video data bit sequentially output by a corresponding one of the first and second sampling cells, and applying the analog signal to a corresponding data line of the liquid crystal panel;

wherein each digital-to-analog conversion cell includes:

a first capacitor connected between a first node and a ground source;

a second capacitor connected between a second node and the ground source;

a first transistor, responsive to a third enable signal, for selectively passing a supply voltage from a supply voltage source to the first capacitor;

a second transistor, responsive to a fourth enable signal, for selectively discharging a voltage stored in the first capacitor to the ground source; and a third transistor, responsive to a conversion driving clock, connected between the first node and the second node; and a buffer connected between the second node and the data line.

7. The circuit of claim 6, further comprising:

a conversion control cell, corresponding to each digital-to analog conversion cell, generating the third and fourth enable signals based on output from an associated one of the first and second sampling cells.

8. The circuit of claim 6, wherein each digital-to-analog conversion cell includes a fourth transistor connected in parallel with the third transistor, and responsive to an inverse of the conversion driving clock.

9. The circuit of claim 6, wherein each first and second sampling cell includes:

a bit memory for storing the bit data;

a first switching element, responsive to one of the first and second enable signals, applying the one bit of video data from the data input line to the bit memory; and a second switching element, responsive to another one of the first and second enable signals, to transfer the bit of video data from the bit memory to the corresponding digital-to-analog conversion cell.

* * * * *